United States Patent [19]

Berruex

[11] Patent Number: 5,004,000

[45] Date of Patent: Apr. 2, 1991

[54] APPARATUS FOR RINSING SURFACES WITH A NON-AQUEOUS LIQUID

[76] Inventor: Serge A. Berruex, En Closelet A, CH-1261 Cheserex, Switzerland

[21] Appl. No.: 473,873

[22] Filed: Feb. 2, 1990

Related U.S. Application Data

[60] Division of Ser. No. 223,679, Jul. 22, 1988, Pat. No. 4,936,921, Continuation of Ser. No. 57,204, May 11, 1987, abandoned.

[30] Foreign Application Priority Data

Sep. 13, 1985 [CH] Switzerland ..... 3984/85
Sep. 11, 1986 [CH] Switzerland ..... PCT/86/00130

[51] Int. Cl.[5] ..... B08B 3/12; B08B 13/00

[52] U.S. Cl. ..... 134/108; 134/61; 134/109; 134/113; 134/184; 134/902

[58] Field of Search ..... 134/1, 42, 902, 61, 134/105, 108, 109, 113, 184

[56] References Cited

U.S. PATENT DOCUMENTS

| | | | |
|---|---|---|---|
| 1,533,711 | 4/1925 | Stevens | 134/1 |
| 3,397,150 | 8/1968 | Burt et al. | 134/1 |
| 3,710,450 | 1/1973 | Figiel | 134/42 |
| 3,957,672 | 5/1976 | Zisman et al. | 134/1 |
| 4,046,154 | 9/1977 | Tada et al. | 134/109 X |
| 4,169,807 | 10/1979 | Zuber | 134/1 |

*Primary Examiner*—Philip R. Coe
*Attorney, Agent, or Firm*—A. D. Messenheimer

[57] ABSTRACT

Rinsing of an aqueous liquid from a hydrophilic surface is accomplished by contact with an inert non-solvent such as a perfluorinated liquid in a manner that creates an emulsion and does not convert the hydrophilic properties of the rinsed surface. By breaking down the emulsion, the insert non-solvent is recycled for re-use and the aqueous liquid is recovered for treatment or re-use. Drying of the rinsed hydrophilic surface is also optionally provided.

12 Claims, 1 Drawing Sheet

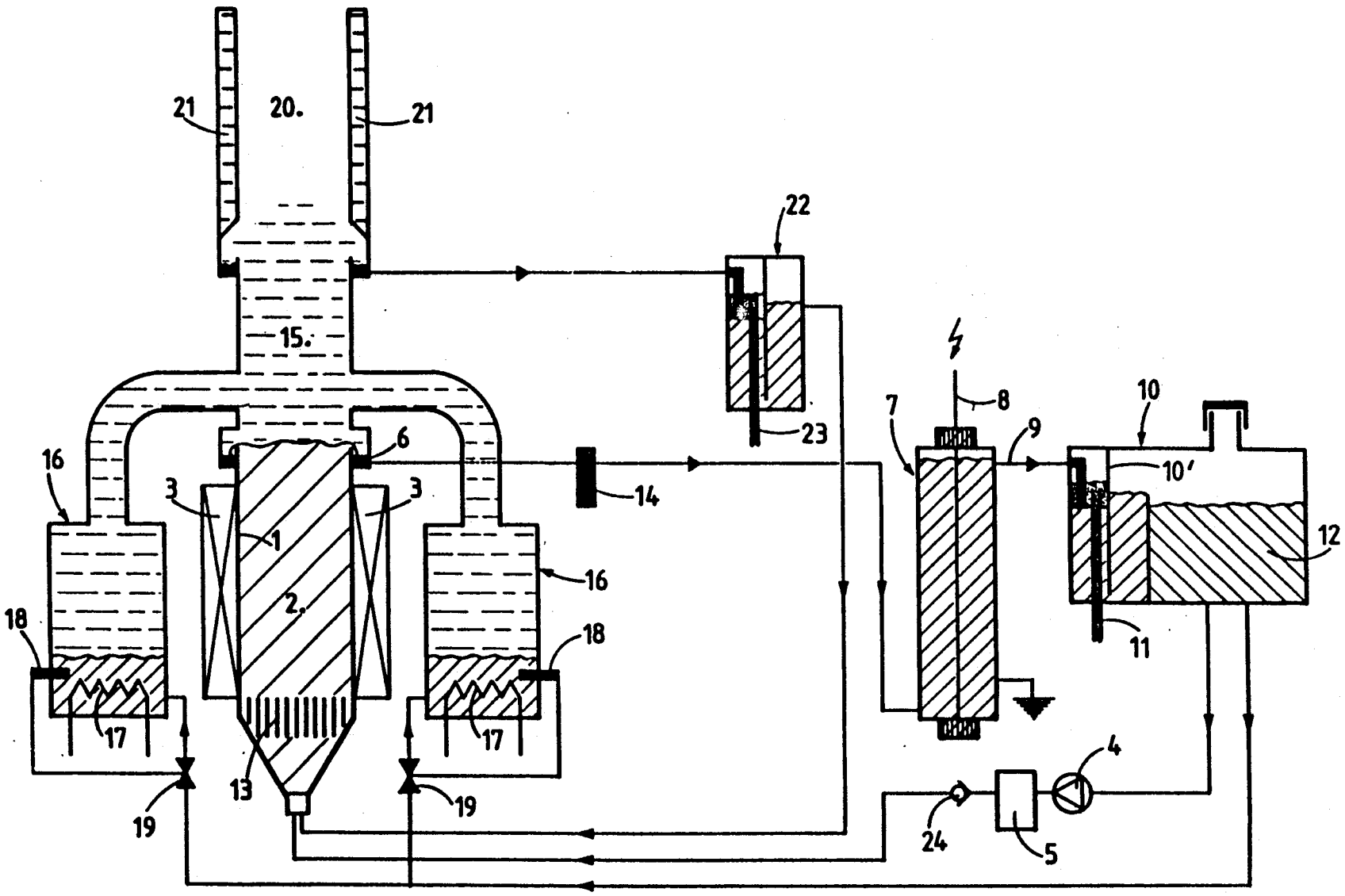
12
10'
10
11
4
5
9
8
24
7
22
23
14
16
18
17
19
21
6
3
20.
15.
2.
1
13
3
19
17
16
18
21

APPARATUS FOR RINSING SURFACES WITH A NON-AQUEOUS LIQUID

RELATED APPLICATIONS

This application is a division of application Ser. No. 07/223,679 filed July 22, 1988, and now U.S. Pat. No. 4,936,921, which is a continuation of Ser. No. 07/057,204 filed may 11, 1987, now abandoned.

The present invention relates to a waterless rinsing process of surfaces, and to an installation for implementing this process.

BACKGROUND OF THE INVENTION

For rinsing hydrophilic surfaces which have been submitted to a physical, chemical or electrochemical treatment in an aqueous medium (galvanic deposition of a coating, engraving, etching, polishing, hardening, degreasing, scouring, development and fixation, oxidation, coloration, etc.) or surfaces which have been formed in an aqueous medium (by crystallization, precipitation, etc.) practically all the methods currently used on an industrial scale, use as a first step the rinsing of the articles with water, followed by the elimination of the water from said surfaces.

This type of method however presents a least two drawbacks, that is that it leads to the formation of important quantities of polluted water which are incompatible with the requirements of the protection of the environment, which are becoming more and more severe, and that the aqueous solutions thus eliminated from the surfaces, even if they can be recovered, are generally degraded and unusable.

With regard to the subsequent drying process, the oldest known method consists in the free or forced evaporation of water to the atmosphere, the main drawbacks being the formation of waterspots and the oxidation of the surfaces, which is generally unacceptable. More modern methods for removing water from surfaces are based on the use of water-repelling liquids. These liquids contain surface-active agents that have the effect of converting hydrophilic surfaces into water-repelling surfaces that are hydrophobic. Other methods use baths such as boiling trichloroethylene or perchloroethylene added also with surface-active agents. The water is thus eliminated by formation of azeotropes, which indicates that water is rendered soluble in the solvent (7% water in the trichloroethylene-water azeotrope), and there is little or no oxidation of the surfaces, but the problem of water spots is not resolved.

The above mentioned drawback can be partly eliminated by the use of chlorofluorinated solvents, also usable directly as cleaning, degreasing and drying agents, alone or in mixture with other products such as alcohols and surface-active agents. For example U.S. Pat. No. 3,397,150 describes means for eliminating water comprising a mixture of trichlorotrifluoroethane and a surface-active agent constituted by the neutralization product of alkylethers of phosphoric acid with an aliphatic amine, forming with water an azeotropic mixture containing about 1% water. The Figiel U.S. Pat. No. 3,710,450 teaches a method to convert hydrophilic surface into hydrophobic surfaces and displace water in a bath containing a chlorinated or chlorofluorinated water-immiscible solvent, with a water-miscible solvent such as isopropanol, often also added with surface-active agents such as those described in the above mentioned U.S. Pat. No. 3,397,150, and forming with water an azeotropic mixture. In addition, CH Pat. No. 499 075 which corresponds to U.S. Pat. No. 3,386,181, proposes the use of chlorofluorinated solvents and of surface-active agents which are not able to form an azeotropic mixture with the water containing more than about 4 weight percent water. Furthermore, U.S. Pat. No. 4,169,807 describes a method of drying silicon based articles using mixtures containing propanol, water and certain perfluorinated compounds.

The main drawback of these methods, which practically always make use of a surface-active agent which decreases the surface free energy of the surface to make it hydrophobic, in addition to the drawbacks already cited relating to the use of rinsing water, consists in that the complete elimination of the surface-active agent is often difficult if not impossible in industrial conditions. The presence on the surface of an article of such a hydrophobic film, even monomolecular, of surface-active agent can be very harmful when a subsequent galvanic or other treatment is required. On the other hand, when the aqueous medium to be removed from a surface is a galvanic plating solution for example, the fact that solvents are used and that azeotropic mixtures are formed between both liquid phases implies that a liquid—liquid extraction phenomenon occurs, which is accompanied by an alteration of the plating solution so that it cannot be directly reused.

SUMMARY OF INVENTION

Consequently, the advantage of this invention is that it overcomes the drawbacks of the methods currently used for rinsing surfaces, by providing a process which does not require the use of water or surface-active agents that can leave film that is detrimental to or otherwise impedes subsequent galvanic or other treatment.

The method according to the invention, to achieve the above purpose, is characterized in that surfaces are treated with a non-solvent and non-miscible liquid, which is thermally stable and chemically inert, in such a manner to form an emulsion with the aqueous liquid present on said surfaces, up to the complete elimination thereof, and allowing hydrophilic surfaces not to be converted into hydrophobic surfaces, and removed aqueous liquids not to be altered. In addition the surfaces can then be subjected to a further rinsing in the presence of vapors of said non-solvent and non-miscible liquid and thereafter to a drying step.

Preferably, the inert non-solvent liquid provided to form an emulsion with the aqueous liquid to be removed should be chosen from among the fully fluorinated organic compounds, for example the type sold under the Trade-Mark "Fluorinert" by the 3M Company. In the following description, these compounds will be designed by IFL (=Inert Fluorinated Liquids). The density of IFL liquids is greater than the density of the aqueous liquid to be removed.

Another element of this invention consists of an installation for implementing the method according to the invention. This apparatus is characterized by the fact that it comprises a first rinsing zone in which means are located for treating the surfaces by an inert non-solvent liquid provided to form an emulsion with the aqueous liquid to eliminate the aqueous liquid which is on said surfaces. This apparatus can also comprise vaporization means of said inert non-solvent liquid in a second rinsing zone, and a drying zone preferably located directly above said second rinsing zone.

The installation may also comprise means for recovering the emulsion and means for breaking down said emulsion, means for separating the two formed liquid phases, as well as separate circuits for recycling the liquids thus separated.

BRIEF DESCRIPTION OF THE DRAWING

The annexed drawing illustrates schematically and by way of example one embodiment of an apparatus according to the invention for the waterless rinsing of surfaces.

DESCRIPTION OF THE PREFERRED EMBODIMENT

Regarding the formation of the emulsion and the breaking down and separation thereof after recovery, any known technique may be used.

For the formation of the emulsion, where the inert non-solvent liquid is the continuous phase and the aqueous liquid to be removed is the discontinuous or dispersed phase, a receptacle containing the IFL and in which the articles are immersed can be used. These articles may be put loosely into baskets or drums, mounted on racks, or suspended in the case of articles of larger sizes, or maintained in the IFL by any kind of support; or in the case of continuous feeding involving by the passage of strips, wires, films, and the like, the feeding may be in a generally vertical direction and pass around a wheel or in a generally horizontal direction beneath or between sprays in the case of printed circuit boards for example.

The emulsion is created preferably through the application of ultrasonic energy, for example at frequencies generally between 20 and 80 kHz, or by more or less vigorous agitation and vibration of the immersed articles to be treated, either mechanically transmitted by an external source, or electro-magnetically induced within the articles, or still by agitation and vibration of the receptacle itself and transmission to the immersed articles by the IFL. These techniques and more particularly the ones using ultrasonic energy are especially appropriate for the treatment of relatively small, high-value articles, in small installations.

For articles with simple shapes, such as printed circuit boards wires or strips, sprinkling and spraying techniques may be used at high pressures to provide the requisite intensity of mechanical agitation.

Finally, for heavy articles having relatively large sizes, treated in high-volume installations, a process of the type called "Hydroson", for example such as described in the publication "Oberflache-Surface" No. 21, 12/1980, is applicable.

As already mentioned, the inert non-solvent liquid used in the method according to the invention is preferably a fully fluorinated organic compound. These compounds, derived from common organic compounds by replacing all the hydrogen atoms by fluorine atoms, thus contain neither hydrogen nor chlorine. These liquids are non-polar and have practically no solvent action, particularly towards water and constituents of industrial aqueous liquids such as galvanic plating solutions. The process according to the invention does not require that the aqueous liquid be at all soluble in the rinse liquid. The solubility of water in the identified IFL liquids ranges from about 15 ppm to as little as about 8 ppm. The IFL liquids are colorless, odorless, nonflammable, only slightly toxic, and of particular importance have a high thermal stability and are chemically inert. These IFL compounds are therefore, with regard to their properties, completely different from the chlorofluorinated solvents generally used as solvents, degreasing and drying agents, etc. Furthermore, the exceptional chemical inertness of IFL mean that they do not convert hydrophilic surfaces into hydrophobic surfaces or contaminate or modify the emulsified aqueous solution and that this aqueous solution may thus be reused directly in the manufacturing process, after the emulsion is demulsified.

Some stable fluorinated surface-active agents can be dissolved, to a certain extent, into IFL. Consequently, although it is not generally required and as long as they do not convert a hydrophilic surface into a hydrophobic surface, it may be useful in some cases to incorporate one or more of them into the IFL in order to increase the efficiency and the rapidity of the rinsing, especially when the sprinkling/spraying technique is used. The same effect may also be obtained by mixing the stable fluorinated surface-active agent with the aqueous liquid to be eliminated.

The preferred use of a fully fluorinated organic liquid does not exclude that other partially fluorinated products, for example "Freon 113", may be also used, in some cases and especially for economical reasons and/or when the qualitative requirements for the surfaces are not as high. In order to compensate for the greater difficulty of causing emulsification of these partially fluorinated products, it is recommended that one or more of the above mentioned surface-active agents may be added.

With regard to the different alternatives available for breaking down an emulsion, one may cite especially the centrifugation, the action of ultrasounds at a determined frequency, the chemical demulsification, the passage of the emulsion through a fine grid, a granular bed, a porous or fibrous material, a hydrophobic membrane, the use of a thermal effect, of ionizing radiations, of magnetic field, the microflotation, the ultrafiltration, etc. The technique which seems to be the most appropriate is that of high tension separating or demulsifying apparatus, of the type described for example in U.S. Pat. No. 1,533,711.

Finally, with regard to the drying of the surfaces, one may cite especially the blowing of cold or warm gas, the use of infrared radiations, the free evaporation, the induction heating, the drying in vapor phase, etc. It appears however that vapor phase drying would be the most appropriate which is well known by the men skilled in the art.

The method proposed by the present invention therefore presents, with respect to the usual methods, the following very important advantages:

- no or much less pollution of the environment, particularly of water;
- full recovery and in their original form of the aqueous liquids removed from the surfaces, and therefore of the metals or other raw materials that they contain;
- hydrophilic surfaces are not converted into hydrophobic surfaces and can therefore receive subsequent galvanic or other treatments without loss of quality;
- utilization of much less space than that necessary to the clarifiers;
- a very significant decrease in the consumption of water for example, the consumption of the chemicals generally used for neutralization and detoxication, the consumption of energy necessary for the evaporation of rinsing waters;

the possibility of using proven manufacturing processes which are currently prohibited or limited due to very important detoxication problems; for example the use of compounds containing cyanides, cadmium, hexavalent chromium, etc.

Furthermore, the creation of an emulsion using a non-solvent and non-miscible liquid allows the method to be used not only for non-absorbing surfaces, but also for articles such as non-glazed ceramics, sintered articles, woven articles, etc. This method may therefore be implemented not only in the technical fields of electroplating, the manufacturing of silicon chips, printed and integrated circuits, etc. but also in photolithography, in the manufacture and the development of photographic films, in the treatment and especially the drying of textiles and in the leather, chemical, mining industries, etc.

One embodiment of the method and apparatus according to this invention will be now described by way of the example and by reference of the annexed drawing.

The articles to be rinsed (not shown) are introduced directly into a vat or receptacle 1 containing the IFL 2 at room temperature. Ultrasonic transducers 3 are put into action to enable the emulsification of the aqueous liquid with the IFL. This emulsion will tend to rise because its density is lower than that of IFL on the one part, and on the other part due to the fact that the IFL is introduced into the vat 1 through the bottom, by means of a recirculation pump 4 and through an intermediary filter 5. Consequently the emulsion 6 overflows the vat 1 and is directed towards a high tension demulsifying apparatus.

This demulsifying apparatus 7 comprises an axial filiform electrode 8 connected to a high tension source and a conductive cylindrical body connected to ground. The emulsion is thus broken down by the coalescing of microdroplets into big drops. The mixture IFL/big drops 9 of removal aqueous liquid is then passed into a settler 10 or "Florentine" pot. The aqueous liquid to be removed, which is less dense than the IFL, floats to the surface and, by successive additions, overflows via the drain pipe 11. The aqueous liquid is recovered and ca be reused directly as such in the manufacturing process. With regard to the IFL, it passes under the wall 10' and overflows into the tank 12 of the settler 10. This part of the tank serves as a balance for the variations in levels for the installation.

As already mentioned, the pump 4 draws the dry and clean IFL out of the tank 12 and passes it through a filter 5; it is then introduced into vat 1 through the bottom via anti-turbulence guides 13 or a porous plate, thus replacing the newly created emulsion with dry and clean IFL.

A turbidity detection device 14 determines when the emulsification process has ended, i.e. as soon as the IFL is perfectly clear. This means that the rinsed surface is completely free of the aqueous liquid. Another alternative for controlling the process consists of incorporating a tension detector and/or a current detector in the high tension circuit of the demulsifying apparatus, the tension being inversely proportional and the current being proportional to the quantity of microdroplets coming into the demulsifying unit.

The articles are then removed from the liquid phase rinsing zone (vat 1) and are passed into a second rinsing zone 15, which contains IFL in a vapour phase. These vapours are produced by two boilers 16 heated by heating elements 17 and fed by the tank 12. A level detection system 18 controls the valves 19.

In zone 15, containing the vapours of IFL, these vapours condense onto the articles which have been extracted from the cold IFL of the vat 1, this having as a consequence that the liquid thus condensed, extremely pure, also eliminates impurities which might still be present on the surface, and that the thermal energy of the vapours is transferred to the articles, which are thus heated. Once warm, the articles may be then removed from the vapour phase zone 15 and introduced into the drying zone 20, whose walls are cooled by a double-mantle 21, in which a refrigerating fluid (water, "Freon", etc.) circulates. The cooling of the walls can also be achieved by a coil in which a refrigerating fluid circulates. Thus, the IFL present on the heated articles evaporates and recondensates on the cold wall of the double-mantle. The IFL thus recondensed flows along the walls into a settler 22 ("Florentine" pot), together with a small quantity of water which results from the humidity of the room air and being also condensed on the walls of the double-mantle, said water floating at the surface of IFL which is more dense, and by successive additions, overflows by a pipe 23 to be drained to a sewer. The IFL thus distillated is re-introduced by gravity into the bottom of the vat 1 or in tank 12. Any impurities brought into the system are collected either in the filter 5, or in the bottom of the boilers 16. Finally, if the pump 4 stops working, a check valve 24 has been provided to prevent the IFL in vat 1 from draining back by gravity into the tank 12.

I claim:

1. Apparatus for removing a film of aqueous liquid from a hydrophilic surface with a non-aqueous liquid, which comprises:

a rinsing zone containing an inert, non-solvent, non-miscible liquid;

means for applying said inert non-solvent liquid against said surface with a force that is effective to form an emulsion with said aqueous liquid being a discontinuous phase and said inert non-solvent liquid being a continuous phase;

means for recovering the emulsion including an emulsion breaking down device which separates the phases of said emulsion; and means recycling the recovered inert non-solvent liquid.

2. Apparatus according to claim 1 which further comprises means for vaporizing the inert non-solvent liquid in a zone for drying said rinsed surface.

3. Apparatus according to claim 2 wherein the drying zone is located directly above said rinsing zone and the inert non-solvent liquid is evaporated from said rinsed surface at said drying zone.

4. Apparatus according to claim 2 in which the walls of the drying zone are cooled by means including a double-mantle.

5. Apparatus according to claim 2 in which the walls of the drying zone are cooled by means in which a refrigerating fluid circulates.

6. Apparatus as defined in claim 1 wherein said means for applying said inert non-solvent liquid provides mechanical agitation.

7. Apparatus as defined in claim 1 wherein said means for applying said inert non-solvent liquid provides mechanical agitation in the form of ultrasonic energy.

8. Apparatus according to claim 1 in which means for breaking down the emulsion is constituted by a high voltage demulsifying device.

9. Apparatus according to claim 8 characterized by the fact that the high voltage circuit of the demulsifying device comprises a detector responsive to electrical current.

10. Apparatus according to claim 8 characterized by the fact that the high voltage circuit of the demulsifying device comprises a detector responsive to electrical voltage.

11. Apparatus according to claim 1 further containing a turbidity detector disposed in a passage for the emulsion as it moves between the rinsing zone and the emulsion breaking down device.

12. Apparatus for removing a film of aqueous liquid from a hydrophilic surface with a non-aqueous liquid, which comprises:

a rinsing zone containing an inert, non-solvent, non-miscible liquid;

means for applying said inert non-solvent liquid against said surface with a force that is effective to form an emulsion with said aqueous liquid, said emulsion having a dispersed phase

* * * * *